US005231928A

United States Patent [19]

Phillips et al.

[11] Patent Number: 5,231,928

[45] Date of Patent: Aug. 3, 1993

[54] MUNITION RELEASE SYSTEM

[75] Inventors: William H. Phillips, Scottsdale; Thomas Palen, Mesa, both of Ariz.

[73] Assignee: Talley Defense Systems, Inc., Mesa, Ariz.

[21] Appl. No.: 573,098

[22] Filed: Aug. 24, 1990

[51] Int. Cl.[5] ..... F42B 4/06; F42B 4/26

[52] U.S. Cl. ..... 102/351; 102/342; 102/350; 102/357

[58] Field of Search ..... 102/342, 350, 351, 357

[56] References Cited

U.S. PATENT DOCUMENTS

| | | | |
|---|---|---|---|
| H959 | 9/1991 | Heckman et al. | 102/357 X |
| 2,972,946 | 2/1961 | Poulter | 102/7.2 |
| 3,295,444 | 1/1967 | Cushing et al. | 102/7.2 |
| 3,461,801 | 8/1969 | Vitale et al. | 102/37.6 |
| 3,631,803 | 1/1971 | Davis | 102/70 R |
| 3,646,889 | 3/1972 | Davis | 102/70 B |
| 3,943,854 | 3/1976 | Zwicker | 102/34.4 |
| 3,999,379 | 12/1976 | LeFebvre | 60/204 |
| 4,380,197 | 4/1983 | Eaton | 102/228 |
| 4,455,943 | 6/1984 | Pinson | 102/489 |
| 4,619,199 | 10/1986 | Giladett | 102/254 |
| 4,688,486 | 8/1987 | Hall et al. | 102/489 |
| 4,690,060 | 9/1987 | Dietrich | 102/352 |
| 4,714,020 | 12/1987 | Hertsgaard et al. | 102/351 |
| 5,033,390 | 7/1991 | Minert et al. | 102/357 X |

*Primary Examiner*—Peter A. Nelson

*Attorney, Agent, or Firm*—Pennie & Edmonds

[57] ABSTRACT

A munition release system for carrier weapons is disclosed. Mechanisms for disengaging and ejecting munitions from the carrier housing operate in response to a common gas generator. Disengagement from the housing is effected just prior to ejection. Use of a common gas source improves reliability, while coordinated disengagement and ejection minimizes forces exerted on the munitions.

29 Claims, 15 Drawing Sheets

MUNITION RELEASE SYSTEM

FIELD OF THE INVENTION

This invention relates to methods and apparatus for ejecting munitions from carrier housings, primarily for military purposes.

BACKGROUND OF THE INVENTION

Carrier weapon systems are those which employ a carrier unit containing one or more munitions to deliver those munitions to a point where they are separately deployed by ejection from the carrier housing.

Various mechanisms have been devised to release and eject munitions from carrier weapon systems. Such mechanisms require two basic features to carry out that task. First, the munitions are engaged to the carrier housing and remain so until they are to be deployed. Thus, it is necessary to disengage the munitions from the housing when the time of deployment arrives. Second, the munitions must be ejected from the housing.

Until now, these devices have employed separate sources of energy to effect the disengagement and ejection. The use of two separate systems to perform the two operations adds to the failure rate of such carrier weapons, and compromises their reliability.

In addition, prior devices have not coordinated the events of disengagement and ejection to minimize the shock and acceleration loads imparted to the munition. This has become an increasingly important consideration in light of the sensitivity of modern munitions to shock and acceleration. Among the damages which may be caused by insufficient protection from these dangers is a degradation of the ability of the munition's target sensors to perform accurately.

It is therefore one object of this invention to provide a method and system for release and ejection of munitions from a carrier weapon housing, characterized by the minimum possible shock and acceleration loads on the munition upon release and ejection.

It is also an object of the invention to provide such a munition release system wherein the disengagement and ejection of the munition from the housing are effected by the same source of energy, to achieve reliability of operation.

A third object of the invention is to provide proper timing between disengagement and ejection functions.

SUMMARY OF THE INVENTION

The present invention provides a munition release system having a housing on which munitions can be mounted in locking engagement. Mechanisms for disengaging and ejecting the munitions from the housing at a predetermined time are provided. These mechanisms operate in response to release of gas from a single gas generator. The gas released from the generator first disengages the munition from the housing through any of several mechanisms, and then ejects the munition from the housing by inflating an inflatable bag located between the housing and the munition. The use of a single energy source, i.e., the gas generator, to effect both the disengagement and the ejection minimizes the possibility of failure and enhances reliability.

Coordination of the disengaging and ejection events so that the former occurs just prior to the latter minimizes the shock and acceleration load exerted on the munition. This coordination is assured by using a mechanism for allowing gas flow into the inflatable bag which is triggered by a higher pressure than the mechanism for disengaging the munition, or by movement of a mechanical barrier after sufficient travel to insure munition disengagement. Thus, inflation of the bag will not occur until the munition is disengaged from the housing.

DESCRIPTION OF THE PREFERRED EMBODIMENTS

Figure 1:
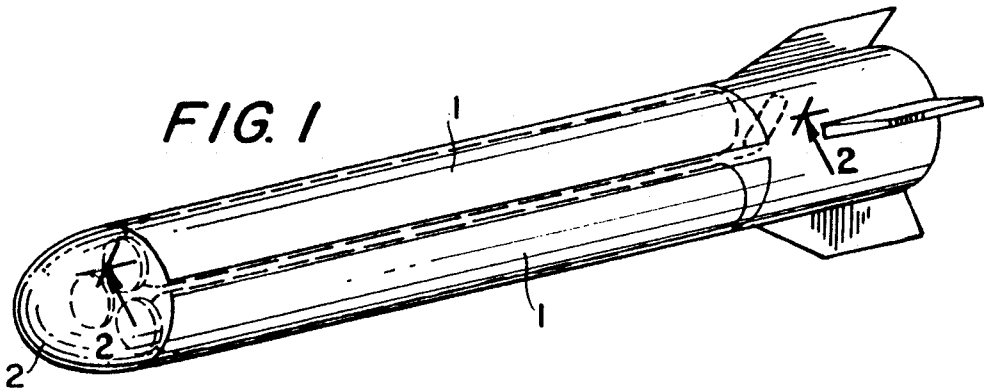
FIG. 1 is a schematic view of the carrier weapon system of the invention.

FIG. 1 shows a carrier weapon system according to the invention having three munitions 1, mounted within housing 2. According to the invention these munitions are engaged to the housing at first, and are then disengaged and ejected in response to a release of gas from gas generator 3. Numerous means for carrying out this desired process are disclosed in FIGS. 2–18.

Figure 2:
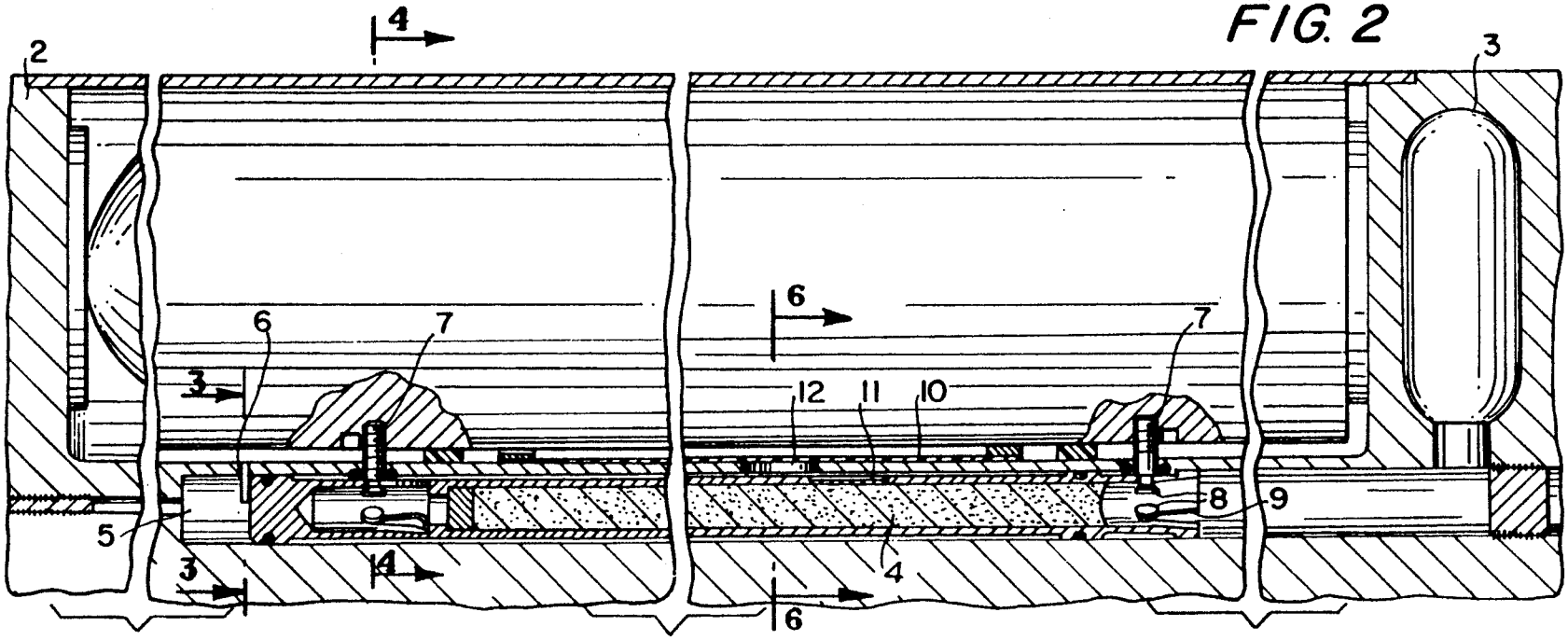
FIG. 2 is a cross-sectional view of the system for disengaging and ejecting munitions according to a first embodiment of the invention.

According to the embodiment shown in FIG. 2, the disengagement and ejection of the munition is accomplished through use of a piston 4 within channel 5 of the housing. The piston is disposed to receive gas from the generator 3 and is forced toward the front of the weapon in response to a release of gas; equivalent configurations could be used which force the piston to the rear.

Figure 3:
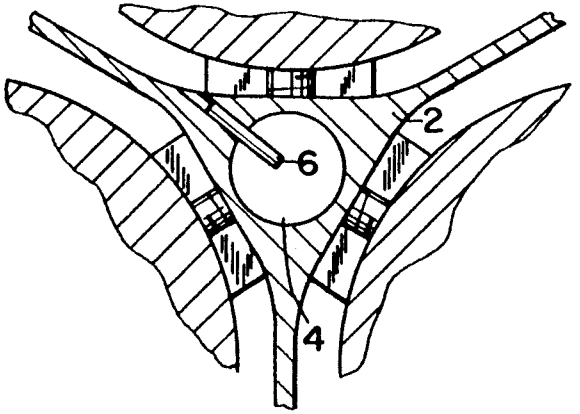
FIG. 3 shows a cross-sectional view of the first embodiment of the invention along lines 3—3 of FIG. 2, at the shear pin.

A shear pin 6 is used to initially restrain piston 4, and is designed to fracture at a predetermined level of force on the piston from the release of gas. FIG. 3 shows a detailed view of the shear pin mounted within the housing 2 and restraining the forward end of piston 4.

Figure 4:
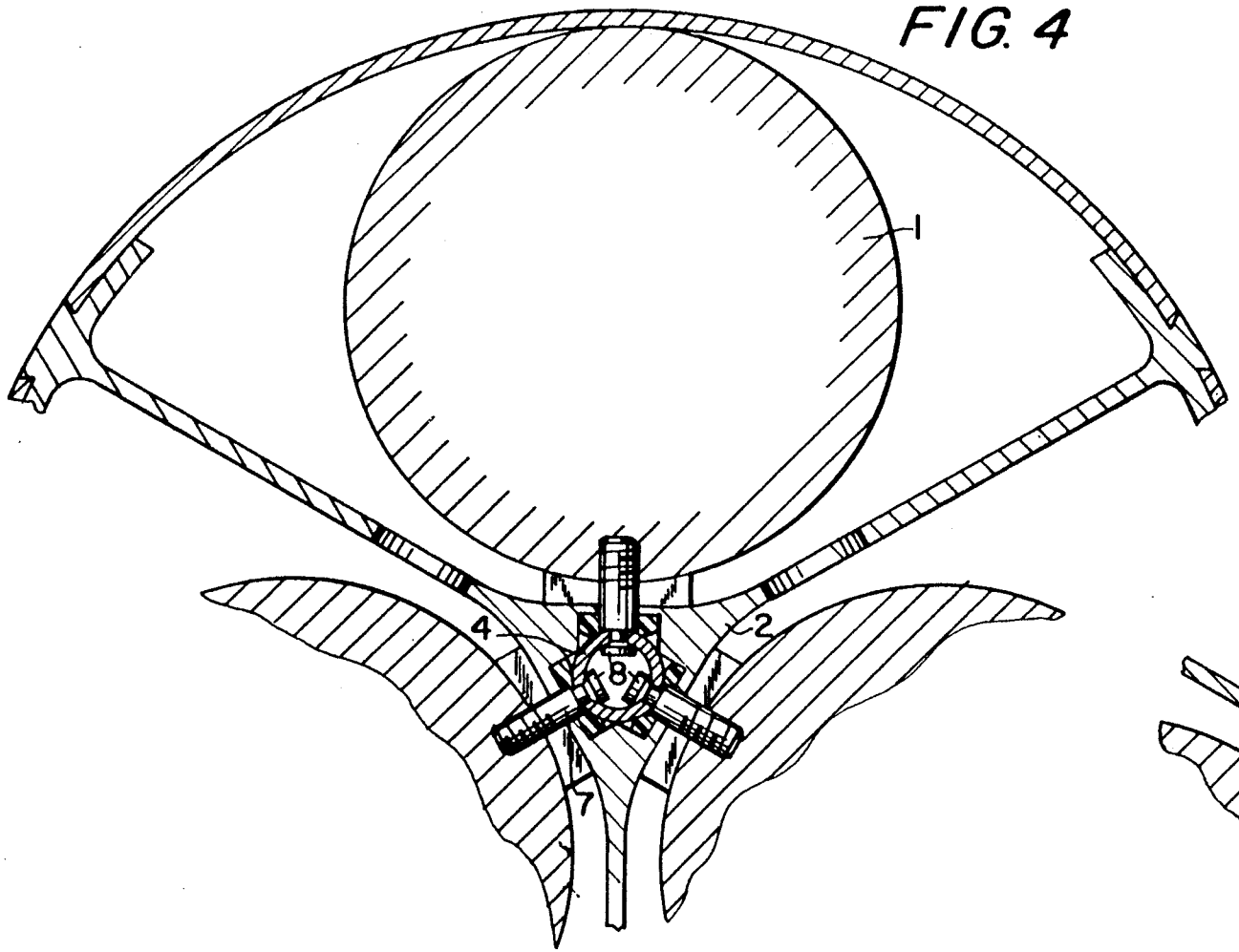
FIG. 4 shows a cross-sectional view of the first embodiment of the invention along lines 4—4 of FIG. 2, at the forward engaging lock pins.

The munition 1 is engaged to the housing 2 by means of lock pins 7, as shown in FIG. 2. One end of the lock pins is permanently mounted on the munition, while the other end is releasably engaged to the piston 4. FIG. 4 shows this mounting arrangement of the three munitions. Lock pins 7 are engaged to piston 4 by pin heads 8. The pin heads interlock with slots 9 in the piston, as shown in FIG. 2.

An inflatable bag 10 is used to eject the munition from the housing. Inflation is achieved through the release of gas from gas generator 3. The disengagement and ejection steps are therefore performed in response to a common energy source. The gas reaches bag 10 through burst disc 11 and burst port 12. Burst disk 11 is a structurally weakened portion of piston 4, which may initially be out of alignment with burst port 12 of the housing. The burst disk would then be aligned with the burst port when the piston shifts in response to the release of gas.

Figure 5:
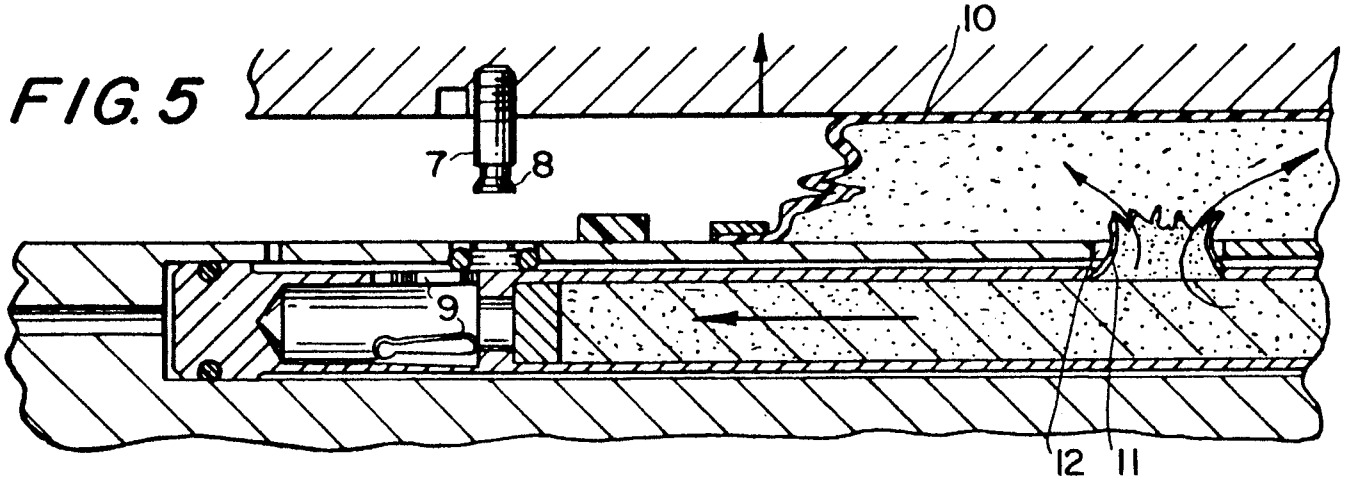
FIG. 5 is a cross-sectional view of the first embodiment of the invention, similar to that of FIG. 2, showing the invention after disengagement and in a partially inflated state.

FIG. 5 shows the operation of the first embodiment of the invention in response to the release of gas. Once a sufficient level of force is exerted on the piston, the shear pin fractures and the piston moves from the first position of FIG. 2 to a second position as shown in FIG. 5. Disengagement of lock pins 7 is effected by this movement of the piston because the slots 9 with which the pin heads 8 interlock are wider at one end than the other. Thus, the lock pins and the munition are released when the piston moves from the first position, where the narrow ends of the slots engage the pin heads, to the second position, where the wide ends of the slots do not engage the pin heads.

Inflation of the bag 10 occurs when burst disk 11 aligns with burst port 12 as a result of the piston moving from a first to a second position, and further when enough pressure has built up in the piston to burst the disk. By coordinating the structural strength of the shear pin 6 and burst disk 11, and by locating the burst disk along the piston to align with the burst port only in the second position of the piston, it is possible to select the timing of disengagement and ejection as desired. Alternatively, the system could function without a burst disk 11 by merely assuring a sufficient seal between piston 4 and channel 5 so that gas does not enter the bag 10 prematurely. Preferably the ejection occurs shortly after disengagement, in order to provide the smoothest launch of munitions.

Figure 7:
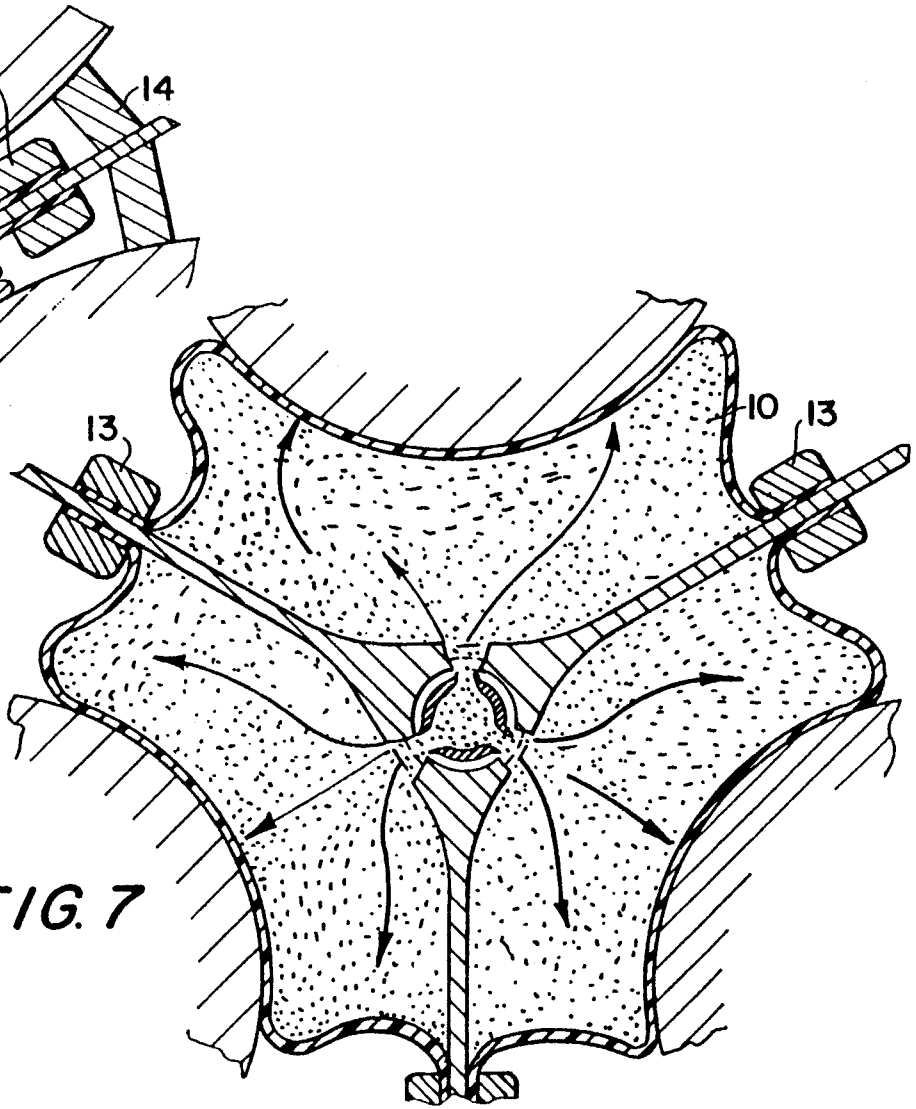
FIG. 7 is a cross-sectional view of the inflatable bag mechanism of the invention, similar to that of FIG. 6, shown in a partially inflated state.
Figure 6:
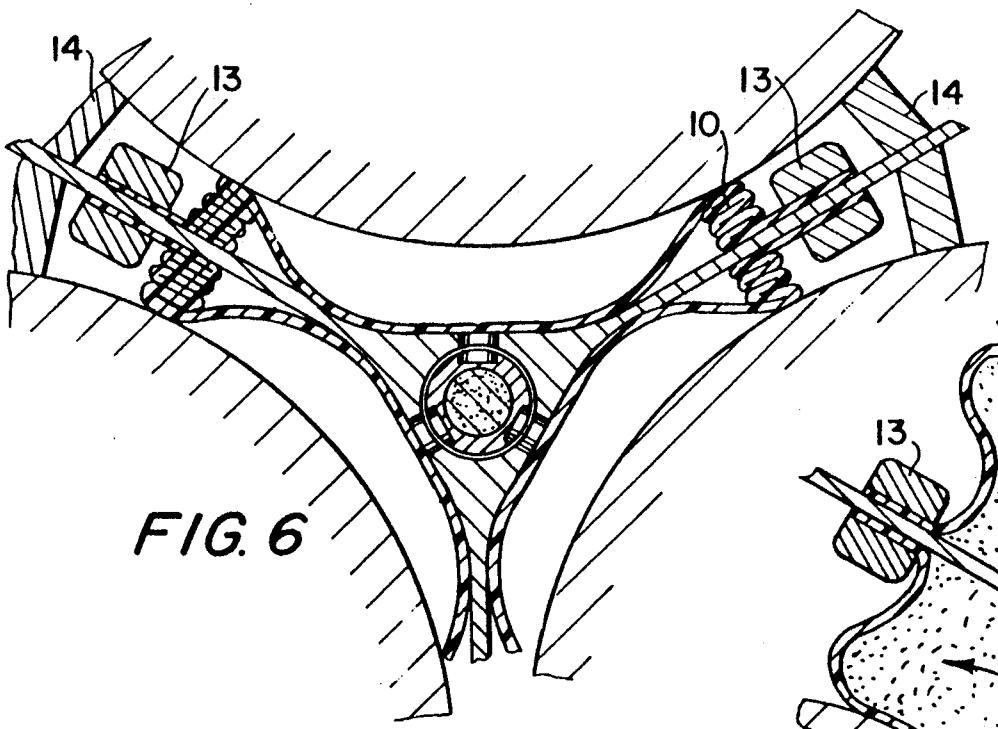
FIG. 6 is a cross-sectional view of the inflatable bag mechanism of the invention, taken along lines 6—6 of FIG. 2.

FIGS. 6 and 7 show the inflatable bag 10 of the invention before and during inflation, respectively. Securing means 13 sealingly connect the bag to the housing. The securing means 13 may consist of a metal strip or bar around the perimeter of the bag and fixed to the housing, as shown in FIGS. 6 and 7, or may be any of a number of means for sealingly mounting such a bag which would be apparent to one skilled in the art. Before ejection, the bag 10 is collapsed as shown in FIG. 6. Preferably, the munition rests on support structures 14 rather than on the bag, to prevent damage to the bag.

Figure 8:
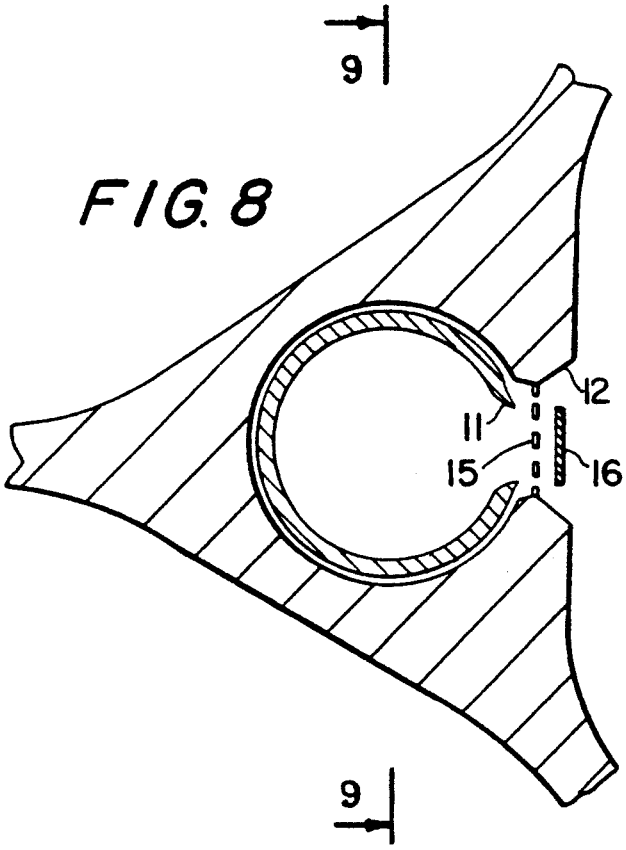
FIG. 8 shows a cross-sectional view of one possible means for controlling the flow of gas into the inflatable bag.
Figure 9:
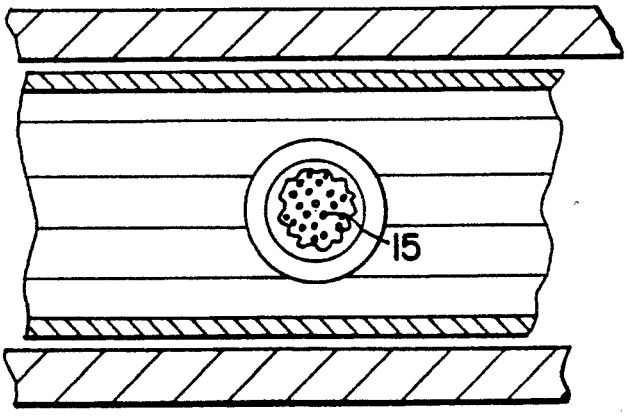
FIG. 9 shows a cross-sectional view of means for controlling the flow of gas into the inflatable bag, taken along lines 9—9 of FIG. 8.

FIGS. 8 and 9 show detailed views of a burst disk 11 and burst port 12, after disk 11 has burst. Preferably a screen 15 and baffle 16 are located in the burst port, to protect the inflatable bag from damage caused by the stream of gas. The screen protects the bag from particles in the gas stream, while the baffle deflects the gas and protects the bag from the heat of the gas by preventing direct impact with the bag and by cooling the gas.

Figure 10:
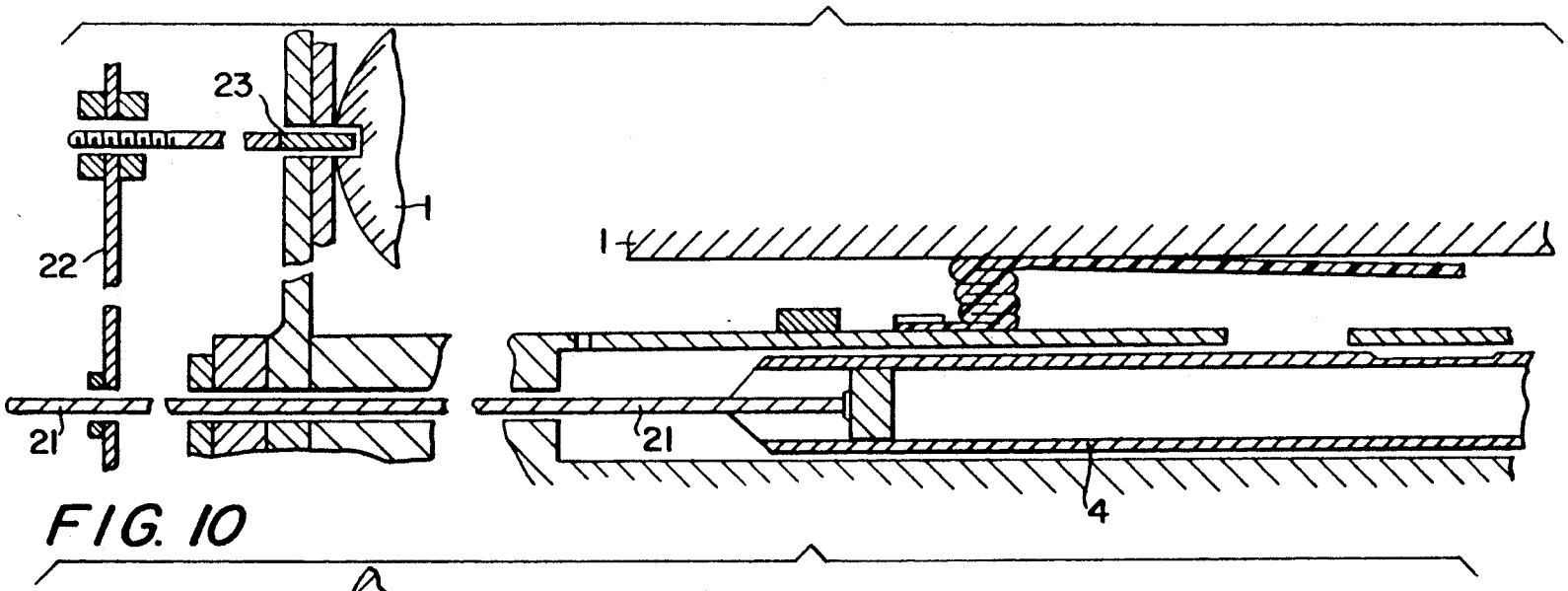
FIG. 10 is a cross-sectional view of the system for disengaging and ejecting munitions according to a second embodiment of the invention.
Figure 11:
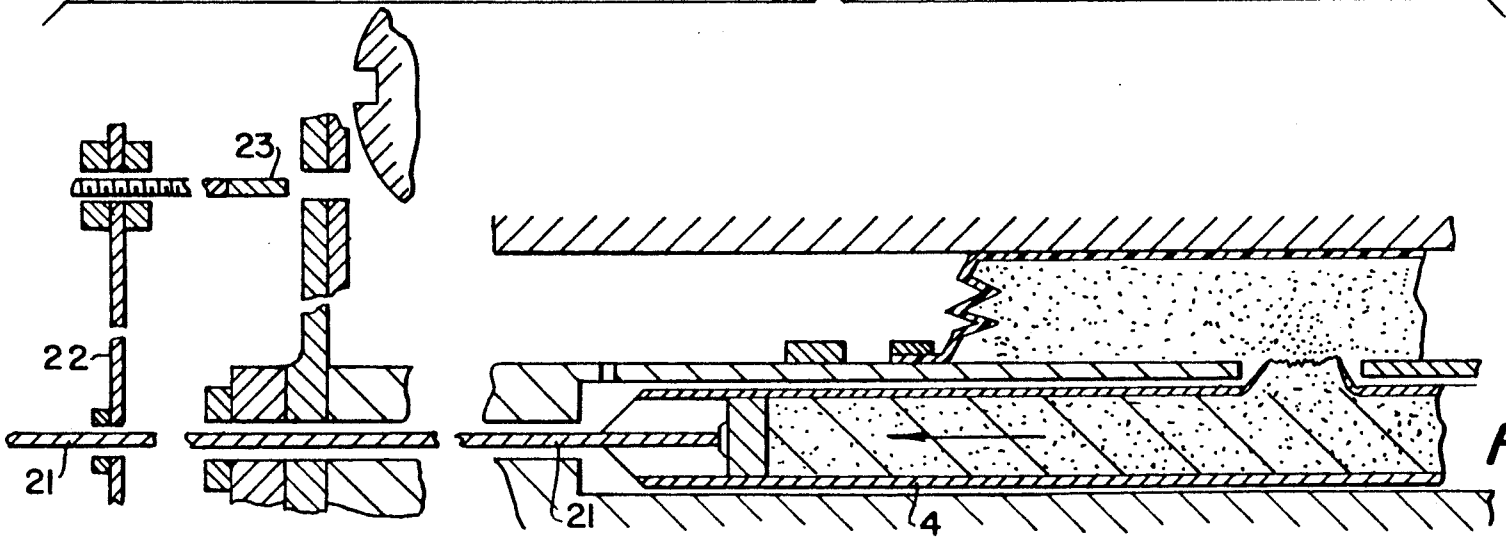
FIG. 11 is a cross-sectional view of the second embodiment of the invention, similar to that of FIG. 10, showing the invention after disengagement and in a partially inflated state.

Another embodiment for engaging the munition to the housing is shown in FIGS. 10 and 11. In this embodiment of the invention, a pushrod mechanism is used to secure and release the munition 1. Rod 21 is connected at a first end to the forward end of piston 4, and at a second end to the center of plate 22. Another rod 23 is connected toward the periphery of the plate for each munition which is to be released. This rod 23 is inserted into a receptor 24 in the nose of munition 1, thereby securing the forward end of the munition. When piston 4 moves to its second position as shown by FIG. 11, the rod withdraws from the receptor 24 and disengages the munition.

This rod 23 may be used to secure the forward end of the munition, while the rear end is secured by an additional rod member, a locking pin as disclosed previously, or other means such as a spring-loaded pressure plate against the rear of the munition. The inflatable bag operates in the same manner as previously discussed to eject the munition.

Figure 12:
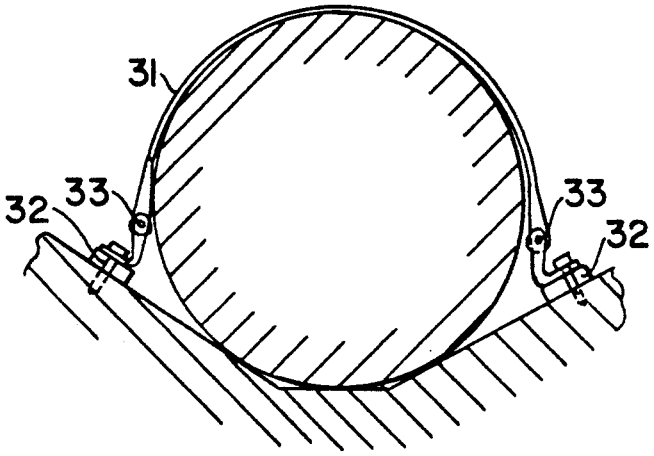
FIG. 12 is a cross-sectional view of the engagement mechanism according to a third embodiment of the invention.
Figure 13:
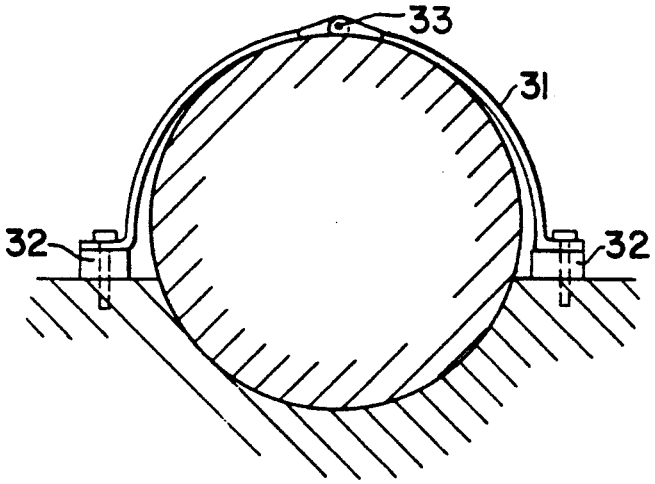
FIG. 13 is a cross-sectional view of the engagement mechanism according to a fourth embodiment of the invention.
Figure 14:
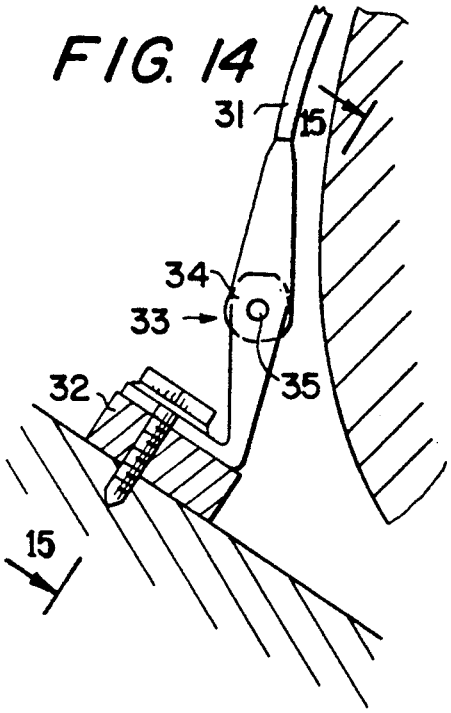
FIG. 14 is a detail view of the engagement mechanism according to the third embodiment of the invention shown in FIG. 12.
Figure 15:
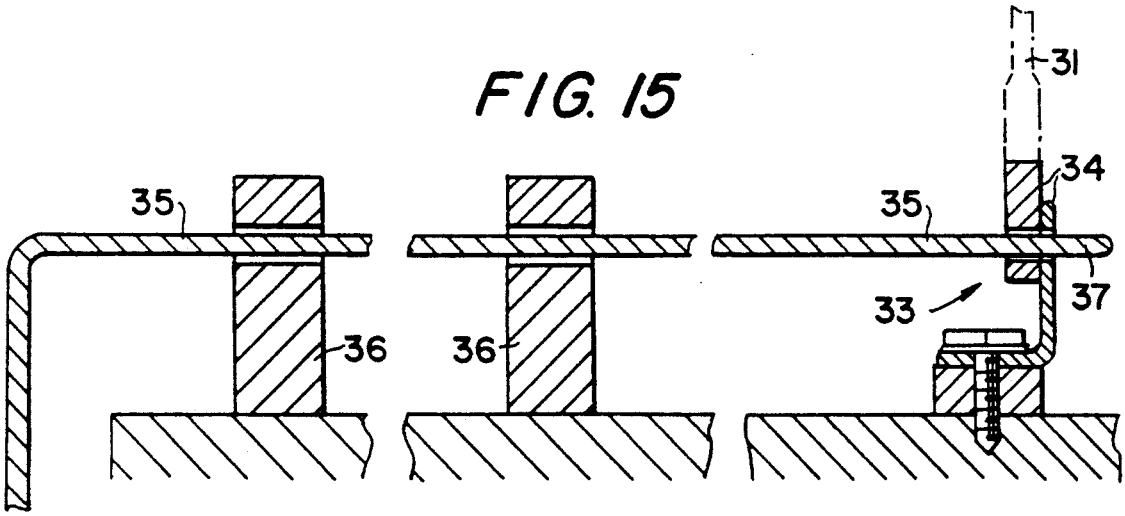
FIG. 15 is a cross-sectional view of the engagement mechanism according to the third embodiment of the invention, taken along lines 15—15 of FIG. 14.

Further embodiments of the invention are shown in FIGS. 12 and 13, respectively. These embodiments both employ a strap 31 or similar restraining means wrapped around the munition 1. The strap 31 is anchored to the housing on both sides of the munition at anchors 32. Along the straps between the anchors is at least one juncture 33 joining two or more sections of the strap together in restraint of the munition. FIGS. 14 and 15 show one such juncture in detail. The strap sections on either side of the juncture have eyelets 34 aligned with and adjacent to one another. A rod means 35, similar to that used in the embodiment of the invention shown in FIGS. 10 and 11, is inserted through the eyelets to join the strap sections together. Because the rod in these embodiments extends along the length of the munition, unlike the embodiment of FIGS. 10 and 11, it may be desirable to use guide supports 36 to stabilize the rod. Movement of the piston from its first position to its second position withdraws the end 37 of the rod from the eyelets 34, thereby separating the strap sections from each other and enabling the munition to be disengaged from the housing by the airbag.

Figure 16:
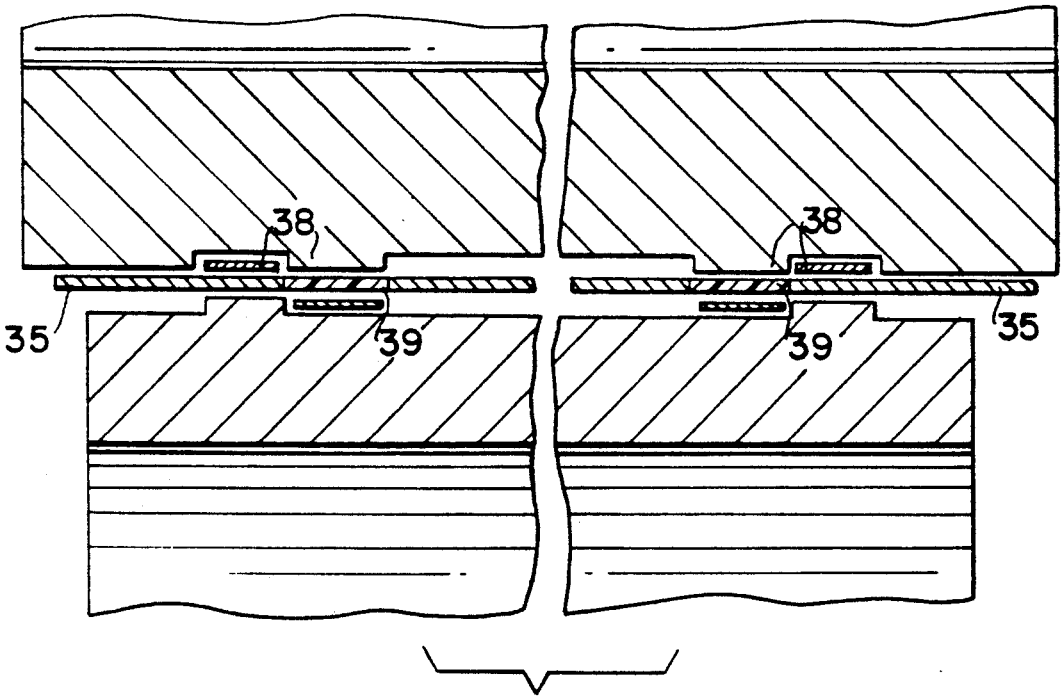
FIG. 16 is a cross-sectional view of an engagement mechanism useful in the third and fourth embodiments of the invention.

Another means for joining and separating the strap sections from one another is shown in FIG. 16. Tabs 38, similar in function to the eyelets shown in FIGS. 12–15, are employed. Instead of withdrawing the end of the rod from the tabs, weakened sections 39 of the rod are designed to be moved into alignment with the tab 38 when tension is exerted on the rod by movement of the piston. These weakened sections are preferably formed of plastic. Once in position the major restraint strength has been removed and the weakened sections 39 can be broken by the ejection action of the bag and munition with minimal shock to the munition.

Figure 17:
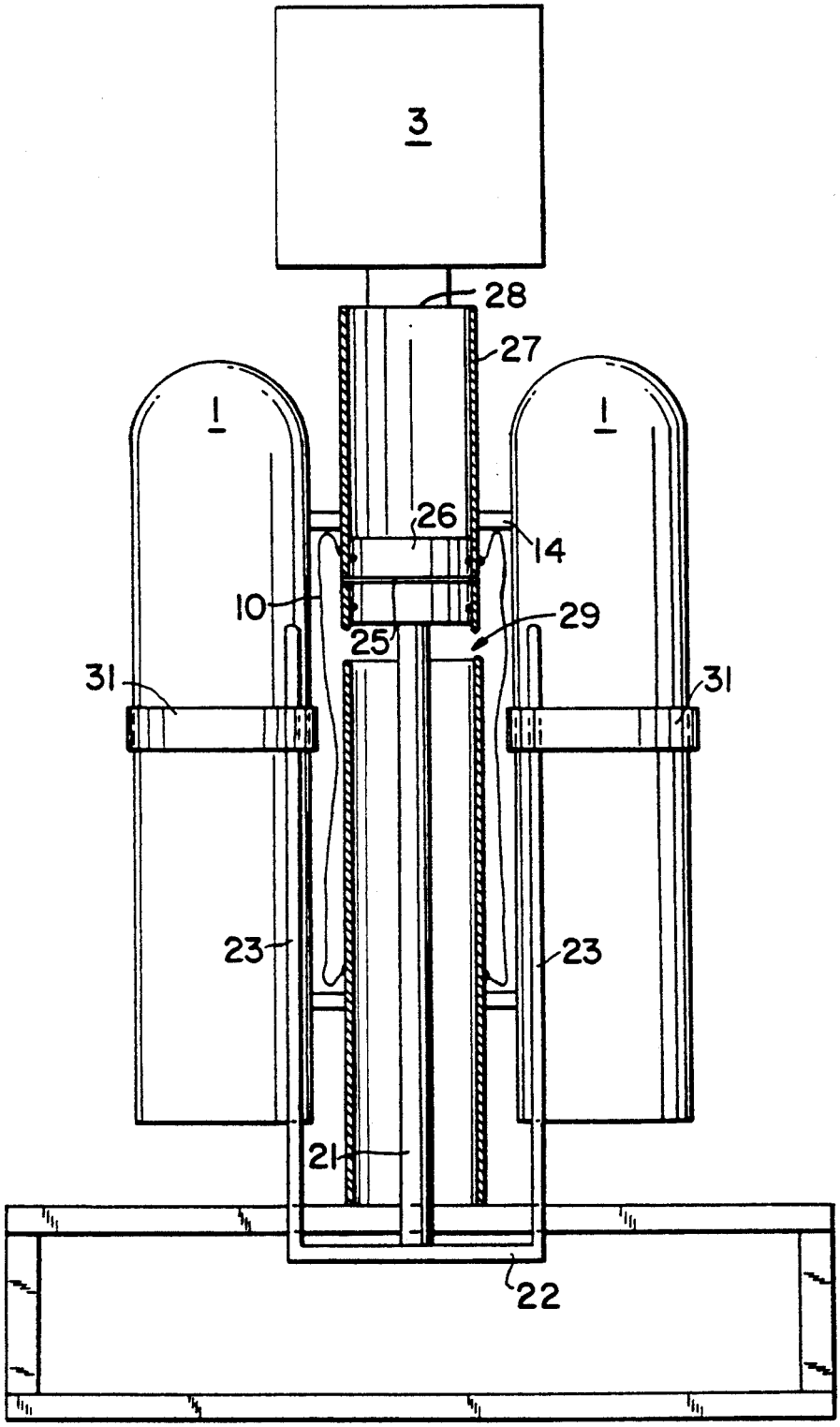
FIG. 17 is a cross sectional view of the system for disengaging and ejecting munitions according to a fifth embodiment of the invention, similar to that of FIGS. 12–15.
Figure 18:
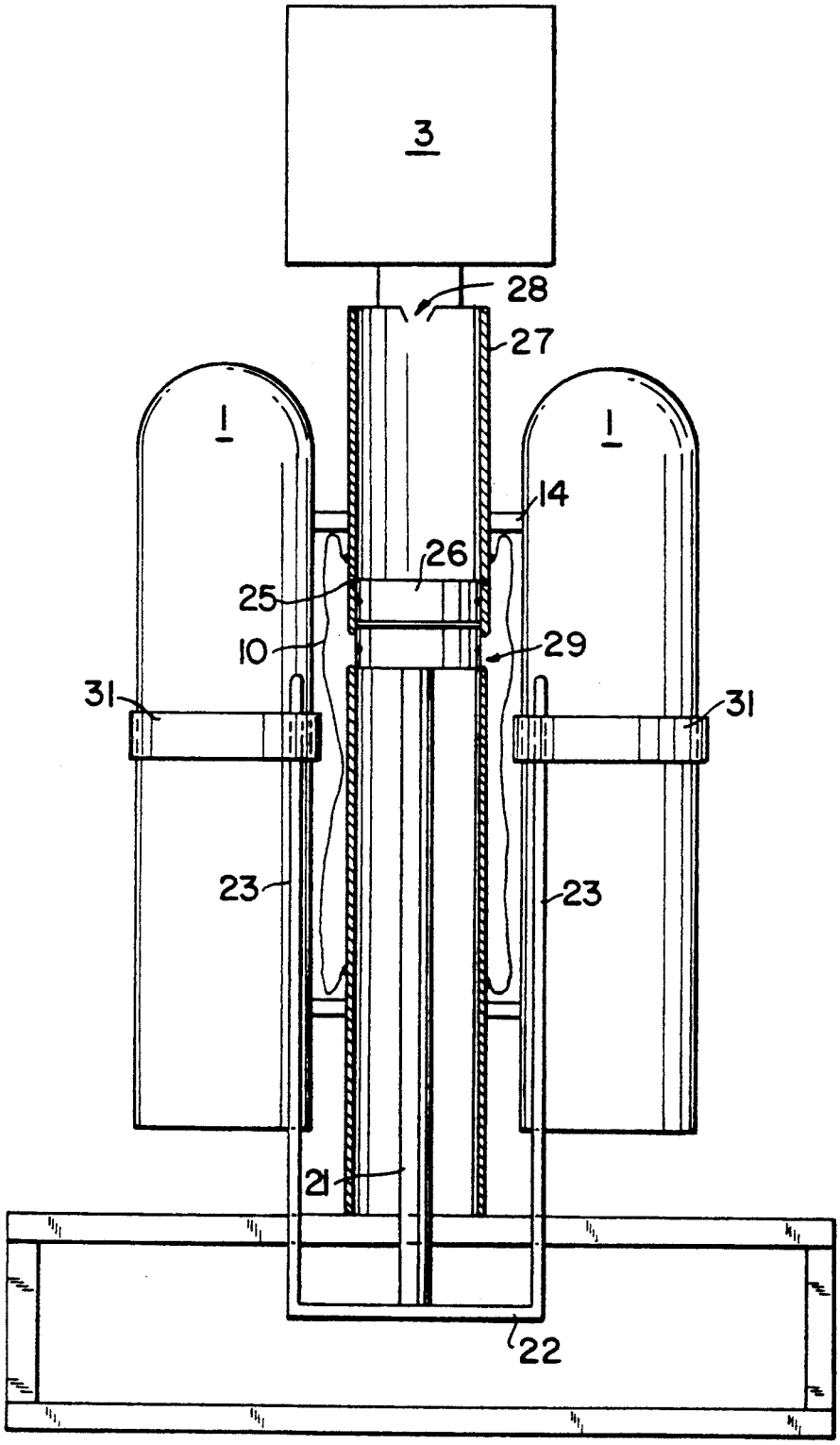
FIG. 18 is a cross-sectional view of the fifth embodiment of the invention, similar to that of FIG. 17, showing the invention after a release of gas and before ejection.
Figure 19:
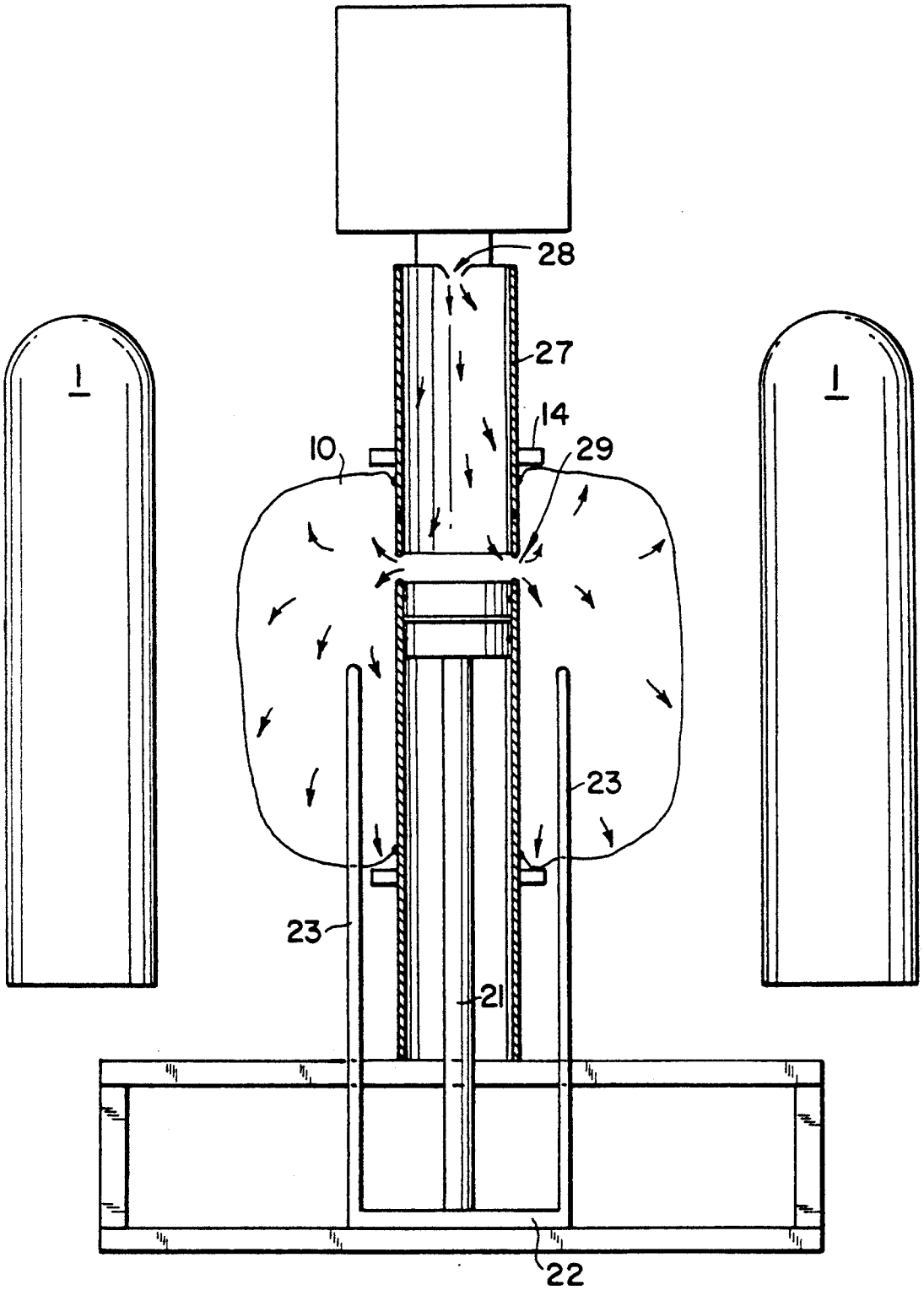
FIG. 19 is a cross-sectional view of the fifth embodiment of the invention, similar to that of FIG. 17, showing the invention after ejection.

Yet another embodiment of the invention is shown in FIGS. 17 through 19. FIG. 17 shows the invention before the release of gas, while FIGS. 18 and 19 show the invention during and immediately after inflation of the bag, respectively. As shown in FIG. 17, the munitions 1 rest on supports 14 and are held in place by straps 31. Straps 31 are engaged by rods 23 connected to plate 22, which is connected to piston rod 21. Piston rod 21 is engaged to piston 26, which is movable within channel 27. Piston 26 moves from a first position to a second position within channel 27 in response to the entry of gas into channel 27 from gas generator 3. Burst disk 28 prevents entry of gas into channel 27 until a predetermined pressure is reached. When disk 28 bursts and piston 26 moves within channel 27, rods 23 disengage from straps 31, releasing the munitions. The munitions are ejected when piston 26 has moved past gas ports 29, as shown in FIG. 21, allowing gas to inflate bags 10.

The timing of the disengagement and ejection events is coordinated by the use of a shear pin 25 to restrain piston 26 in a first position within channel 27 until a predetermined pressure is reached on the piston. Timing is further affected by the geometric relationship between the piston 26 and the gas ports 29 as the piston moves past the gas ports. Acceleration of the munition in the ejection process is a function of the shear pin, the volume of channel 27, the size of the gas ports 29, the type of inflatable bag used, and the type of gas propellant used.

Figure 20:
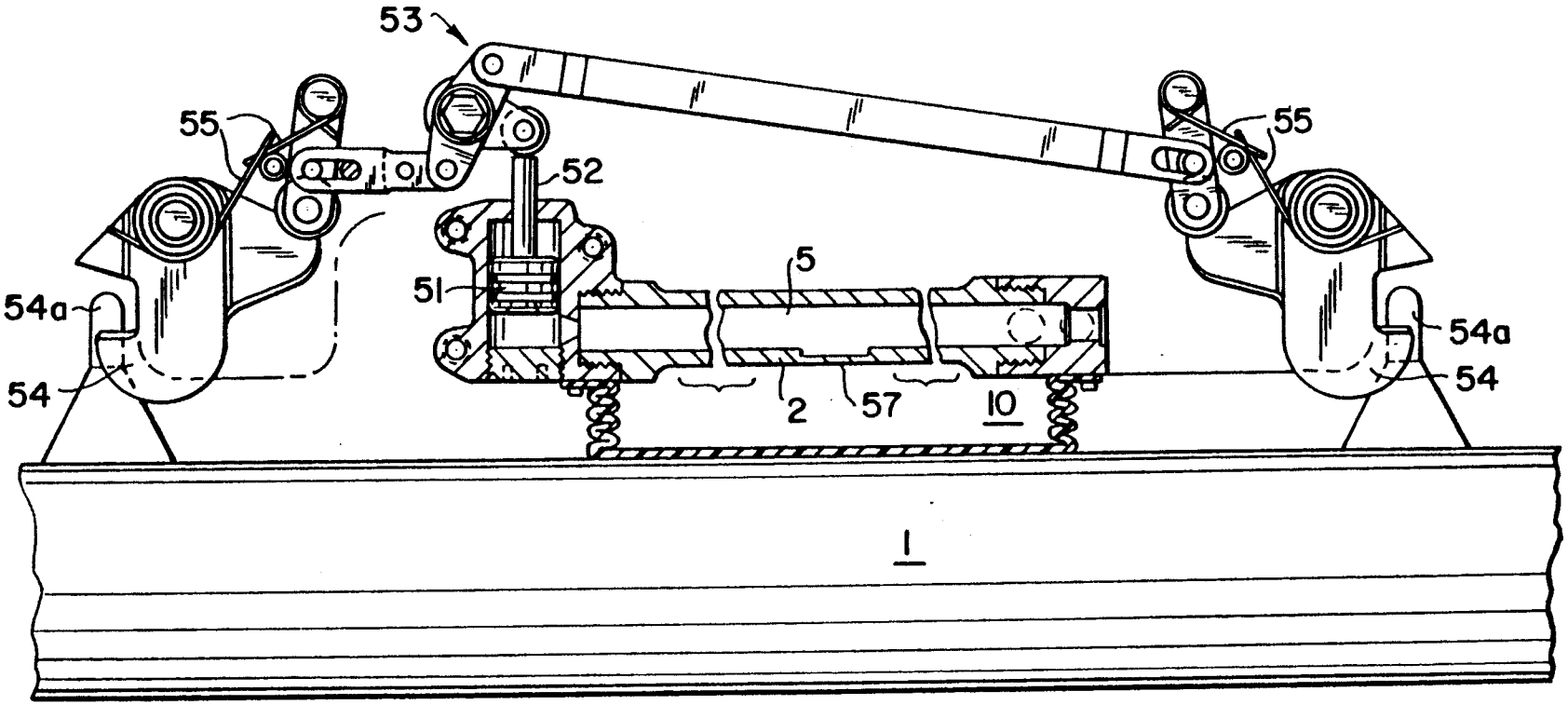
FIG. 20 is a cross-sectional view of the engagement mechanism according to a sixth embodiment of the invention.
Figure 21:
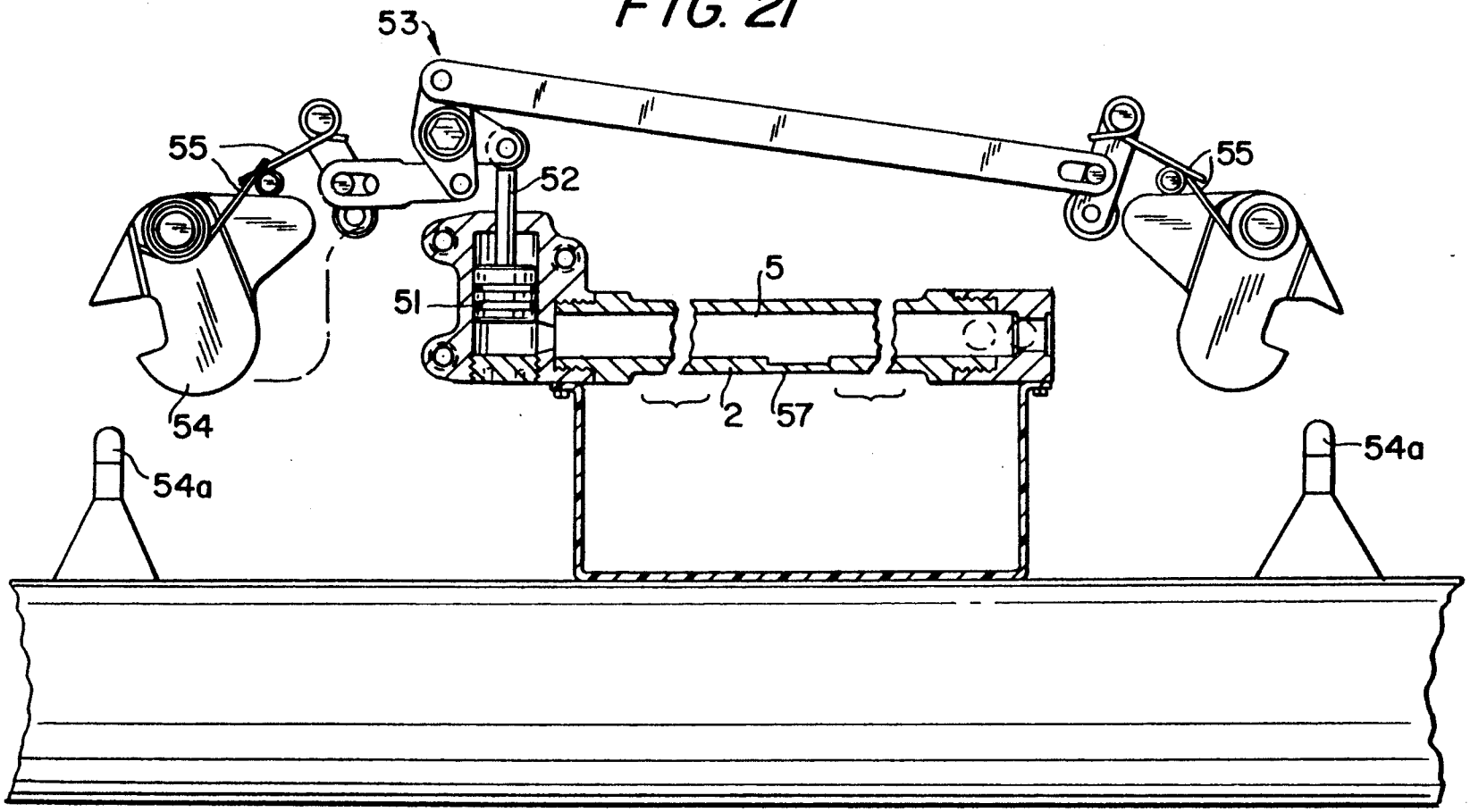
FIG. 21 is a cross-sectional view of the sixth embodiment of the invention, similar to that of FIG. 20, showing the invention after ejection.
Figure 22:
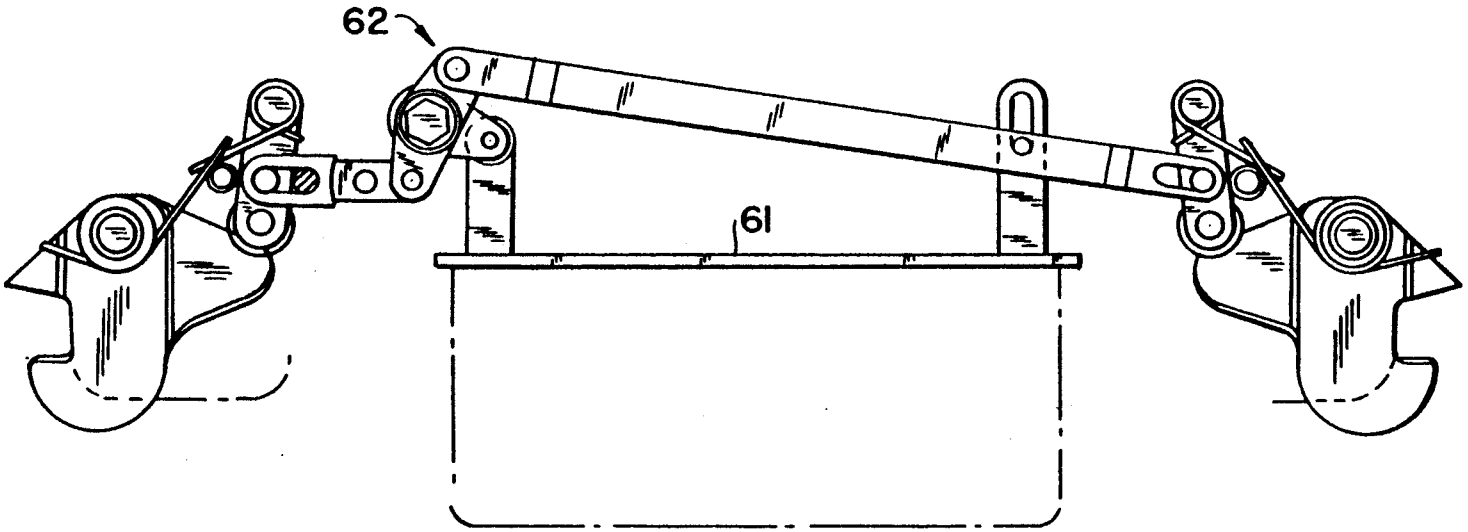
FIG. 22 is a cross-sectional view of the engagement mechanism according to a seventh embodiment of the invention.

FIGS. 20–22 depict further embodiments of the invention, each of which may be used either as part of a carrier weapon system or as part of a weapon release system on board an aircraft. Such on-board uses would include mounting under the wings or fuselage, or in the bomb bays, of airplanes or helicopters. In these cases, the housing which carries the munition is not a carrier weapon but a structural attachment of the aircraft which is not itself released from the aircraft.

In FIGS. 20 and 21, piston 51 is displaced in response to the release of gas from the generator. Pushrod 52 sets linkage 53 in motion, which in turn moves latch means 54 inward. These latch means engage a munition 1 until the latch means are opened inwardly, at which time the munition is released, as shown in FIG. 21. Normally the latch means are urged outwardly by springs 55, as shown in FIG. 20.

In conjunction with the piston which disengages the munition, an inflatable bag 10 is used to eject the munition. This operates in the same manner as the inflatable bag ejection mechanism disclosed previously. However, a burst disc 57 or similar pressure-operated valve is disposed in the housing 2 and not in a piston, because there is no piston within channel 5 in this embodiment. As a result the burst disc is exposed to gas pressure throughout the disengagement step, and the coordination of the burst disk strength with the pressure at which piston 51 operates to release the munition determines the relative timing of the disengagement and ejection events. Alternatively, the system may be provided with a second burst disk 58 at the end of channel 5 to control the timing of the events. Burst disk 58 would be of a lower burst pressure than burst disk 57 in order to release the munition before ejecting it.

FIG. 22 illustrates yet another embodiment of the invention. Inflation of the bag exerts pressure against plate 61, setting linkage 62 in motion. The bag is mounted so that it also inflates in a direction away from plate 61, in order to eject the munition. Timing of the disengagement and ejection steps here depends upon the resistance of plate 61 and linkage 62. By minimizing that resistance, the pressure on plate 61 required to release the munition is lessened, and the munition will be released sooner in the inflation of the bag.

Although the various embodiments of the present invention are primarily intended for use in carrier weapon systems, the invention may be used for other munition release applications as well, and is not limited to carrier weapons.

We claim:

1. A method for releasing munitions which are releasably secured to a housing, which comprises:

activating a source to generate a pressurized gas within the housing;

initially disengaging the munition from securement to the housing in response to the initial generation of gas; and then ejecting the unsecured munition from the housing in response to further generation of gas.

2. The method of claim 1 wherein the munition is ejected by inflating an inflatable member with the pressurized gas.

3. The method of claim 2, wherein the munition is completely disengaged from the housing before the inflation of said inflatable member begins.

4. The method of claim 2, further comprising the step of controlling the flow of gas at a predetermined rate into said inflatable member.

5. The method of claim 2, wherein the inflation of said inflatable member is prevented until a predetermined gas pressure is reached.

6. The method of claim 1, wherein the pressurized gas disengages the munition from the housing by moving a piston from a first position to a second position, said piston triggering disengagement of the munition from the housing when moved to the second position.

7. The method of claim 6, wherein said piston prevents fluid communication of the pressurized gas with ejection means when said piston is in the first position and said piston allows fluid communication of the pressurized gas with ejection means when said piston moves from the first position to the second position.

8. A method for releasing munitions from a housing which comprises sequentially:

securing the munition to the housing with engaging means;

activating a gas generator to generate a pressurized gas within the housing;

triggering disengaging means to disengage the munition from the housing in response to the generation of gas; and ejecting the munition from the housing by inflating an inflatable member with the gas in response to the generation of gas.

9. The method of claim 8, which further comprises preventing gas flow into the inflatable member until a predetermined pressure is achieved.

10. The method of claim 9 wherein the flow of gas is prevented by a first rupturable valve.

11. The method of claim 10, which further comprises the first rupturable value rupturing at a higher gas pressure than the pressure at which the engaging means disengages the munition.

12. The method of claim 9, wherein the generation of gas disengages the munition form the housing by moving a piston from a first position to a second position where the piston triggers the disengaging means, the piston remaining in the first position until a predetermined pressure is exerted against the piston by the gas.

13. The method of claim 12, which further comprises retaining the piston in said first position by a pin until the predetermined gas pressure is exerted against the piston.

14. The method of claim 12, wherein the munition is secured to the housing by a slotted member releasably attached to a lock pin, and which further comprises disengaging the munition from the housing by disengaging the slotted member from the lock pin when the piston moves to the second position.

15. The method of claim 12, wherein the munition is secured to the housing by first rod means connected at a first end to the piston and second rod means operatively associated with the first rod means, and which further comprises disengaging the munition from the housing by disengaging the second rod means from the munition when the piston moves to the second position.

16. The method of claim 15, wherein the munition is secured to the housing by a first end of the second rod means engaging a correspondingly configured slot in the munition, and by connector means engaging second ends of each of the first and second rod means, and which further comprises releasing the munition from the housing when the piston moves to the second position by disengaging the first end of the second rod means from the slot in the munition.

17. The method of claim 15, wherein the munition is secured to the housing by a strap which is engaged to the second rod means, and which further comprises releasing the munition from the housing by disengaging the strap from the second rod means when the piston moves to the second position.

18. The method of claim 17, wherein the step of inflating the inflatable member further comprises permitting entry of gas into the inflatable bag through a plurality of gas ports, wherein the piston prevents flow of gas through the gas ports in the first position and permits flow of gas through the gas ports in the second position.

19. The method of claim 10, wherein the munition is secured to the housing by linkage means and a piston operatively associated therewith, and wherein the generation of gas disengages the munition from the housing by moving the piston from a first position where the linkage means releasably secures the munition to the housing, to a second position where the munition is disengaged from the housing.

20. The method of claim 19, wherein the linkage means comprises a plurality of linkage members operatively associated with a latch means, and spring means for normally setting the latch means in a closed position, and which further comprises disengaging the munition by forcing the spring means to allow the latch means to move to an open position.

21. The method of claim 20, which further comprises preventing the gas flow into the inflatable member until the gas exerts a predetermined pressure on the first rupturable valve, and preventing gas flow to the piston until the gas exerts a predetermined pressure on a second rupturable valve.

22. The method of claim 10, wherein the release of gas disengages the munition from the housing by moving a plate member operatively associated with the inflatable member and capable of moving from a first position to a second position in response to the initial expansion of the inflatable member, and releasably securing the munition with a linkage means operatively associated with the plate member when the plate member is in the first position, and for disengaging the munition when the plate member is in the second position.

23. The method of claim 22, wherein the linkage means comprises a plurality of linkage members operatively associated with a latch means, and a spring means for normally setting the latch means in a closed position.

24. The method of claim 15, which further comprises fastening the munition to the housing with a strap means wherein the strap means comprises a first strap section and a second strap section, and which further comprises securing each of the first and second strap sections to the housing at a first end, engaging the first end of the second rod means with the loops of the first and second strap sections when the piston is in the first position, and disengaging the first end of the second rod means from the loops when the piston is in the second position.

25. The method of claim 24, wherein the piston moves within a channel, the channel having a plurality of ports for gas flow from the channel to the inflatable member, and which further comprises preventing gas flow to the inflatable member with the piston until the piston moves at least partially from the first position to the second position.

26. The method of claim 15, further comprising the step of supporting and stabilizing the second rod means with a guide means connected to the housing.

27. The method of claim 8, wherein the housing is a structural component of an aircraft.

28. A method for disengaging and ejecting a munition from a housing which comprises:

providing a housing; a munition disposed within the housing; securing means disposed in contact with the munition for securing the munition in the housing; disengagement means disposed adjacent the securing means for releasing the securing means from the munition; ejection means disposed adjacent the munition for ejecting the munition from the housing; a gas generator for producing a pressurized gas, the gas generator being in closed fluid communication with the disengagement means; and means for placing the gas generator in closed fluid communication with the ejection means upon the attainment of a predetermined gas pressure; with the disengagement means and ejection means each capable of being activated by the gas produced by the gas generator;

securing the munition within the housing by the securing means;

activating the gas generator to generate a gas;

activating the disengagement means by use of the gas;

placing the gas generator in closed fluid communication with the ejection means; disengaging the munition from the housing; and ejecting the munition from the housing using the ejection means activated by the gas.

29. The method of claim 27 wherein the gas generator is placed in closed fluid communication with the ejection means after the munition is disengaged from the housing.

* * * * *